United States Patent [19]

Howard

[11] Patent Number: 4,544,900

[45] **Date of Patent: * Oct. 1, 1985**

[54] POLARIZED SIGNAL RECEIVER SYSTEM

[75] Inventor: H. Taylor Howard, San Andreas, Calif.

[73] Assignee: Chaparral Communications, Inc., San Jose, Calif.

[ * ] Notice: The portion of the term of this patent subsequent to Nov. 8, 2000 has been disclaimed.

[21] Appl. No.: 403,292

[22] Filed: Jul. 30, 1982

Related U.S. Application Data

[63] Continuation-in-part of Ser. No. 322,446, Nov. 18, 1981, Pat. No. 4,414,516.

[51] Int. Cl.[4] ..... H01P 1/16

[52] U.S. Cl. ..... 333/21 A; 343/786

[58] Field of Search ..... 333/21 R, 21 A; 343/786

[56] References Cited

U.S. PATENT DOCUMENTS

| | | | |
|---|---|---|---|
| 2,548,821 | 4/1951 | Riblet et al. | 343/786 X |
| 2,599,753 | 6/1952 | Fox | 333/21 A |
| 2,880,399 | 3/1959 | Murphy | 333/21 R X |
| 4,168,504 | 9/1979 | Davis | 343/786 |
| 4,414,516 | 11/1983 | Howard | 333/21 A |
| 4,420,729 | 12/1983 | Ashforth | 333/21 A |

*Primary Examiner*—Paul Gensler

*Attorney, Agent, or Firm*—F. David LaRiviere

[57] ABSTRACT

A rotatable polarized signal receiver, having a rectangular waveguide orthogonally coupled to a circular waveguide, has a receiver probe portion oriented in the circular waveguide and a signal launch probe portion extending into the rectangular waveguide. A dielectric insert located in the circular waveguide transforms circularly polarized signals to linearly polarized signals. Since the receiver probe portion can be rotated right circular or left circular polarization can be selected and received.

5 Claims, 6 Drawing Figures

POLARIZED SIGNAL RECEIVER SYSTEM

CROSS REFERENCE TO RELATED APPLICATION

This is a continuation in part of U.S. patent application Ser. No. 322,446 filed on Nov. 18, 1981, now U.S. Pat. No. 4,414,516.

BACKGROUND AND SUMMARY OF THE INVENTION

In satellite retransmission of communication signals, two linearly polarized signals, rotated 90 degrees from each other, are used. Circularly polarized signals are also used. In less expensive installations for receiving linearly polarized signals, the feed horn for the receiving system is installed with orientation parallel to the desired signal polarization. The other polarization is not detected and is simply reflected back out of the feed horn. For more expensive installations, the entire feed horn and low noise amplifier ("LNA") system is mounted on a rotator similar to the type used on home television antennaes to select the desired signal polarization.

While the above-mentioned systems are cost effective, they are mechanically cumbersome and limit system performance. Other prior art signal polarization rotators electrically rotate the signal field in a ferrite media. While such rotators eliminate the mechanical clumsiness of the above-described rotators, they are expensive and introduce additional signal losses (approximate 0.2 DB) into the receiving system. See, for example, such an electronic antennae rotator marketed under the trade name "Luly Polarizer" by Robert A. Luly Associates, P. O. Box 2311, San Bernardino, CA.

The present invention eliminates the mechanical disadvantages of several prior art rotators and eliminates signal losses associated with other prior art rotators. A signal detector constructed according to the principles of the present invention comprises a transmission line having a signal received probe portion ("RP portion") mounted in a dielectric rod at one end of a circular waveguide and a signal launch probe portion ("LP portion") extending into a rectangular waveguide perpendicularly coupled to the circular waveguide. The RP portion of the transmission line detects polarized incoming signals in the circular waveguide and the LP portion launches the detected signal into the rectangular waveguide for transmission to an LNA.

In one embodiment of the present invention, the transmission line, by its coupling to the insulator rod, may be rotated continuously and selectively by a servo motor mounted on the waveguide assembly. As the RP portion rotates to receive the desired signal, the LP portion also rotates. However, the launched signal or the signal received at the LNA is unaffected because rotation of the LP portion is about its axis of symmetry in the rectangular waveguide. The RP portion in the circular waveguide rotates between the two orthogonally polarized signals impinging on the feed horn. By rotation to the desired polarization, that signal is received and the other reflected. The selected signal is then conducted along the transmission line to the rear wall of the circular waveguide portion of the feed horn and is launched into the rectangular waveguide by the LP portion.

Circularly polarized microwave signals are either left or right circular polarizations, LCP or RCP, respectively, and comprise two linearly polarized signals. Such signals are also used in earth-to-satellite communications to provide polarization diversity and frequency re-use. For convenient processing of such signals, it is desirable to transform them into linearly polarized signals.

In another embodiment of the present invention, a dielectric insert is interposed between the RP portion and the incoming signal. The insert transforms RCP or LCP into linearly polarized signals rotated 90 degrees from each other in accordance with well-known principles described in the prior art as the "delay-advance technique". In that technique an impedance is introduced into the transmission line to delay one component of the RCP and LCP. Since the RP portion can be rotated to any desired orientation in the circular waveguide, RCP or LCP can be conveniently selected and received by this feature of the present invention.

DESCRIPTION OF THE PREFERRED EMBODIMENT

Figure 1:
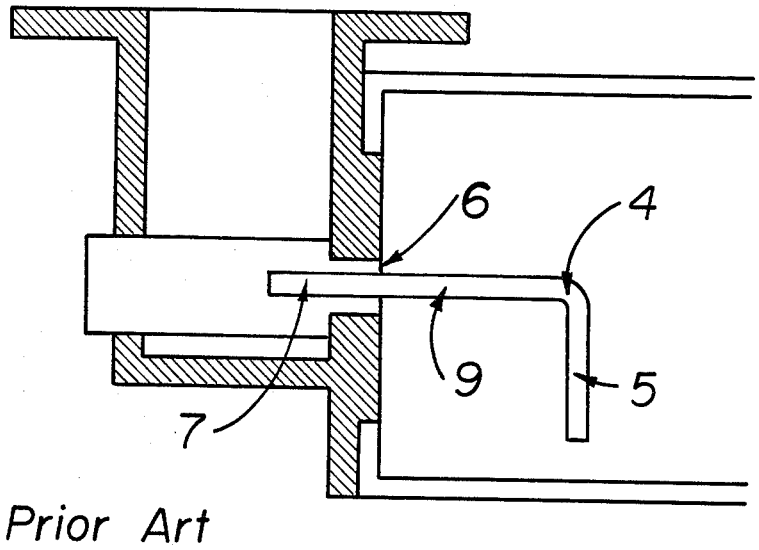
FIG. 1 is a cross-sectional view of a prior art waveguide assembly with an internal rotating signal detector.

Referring first to FIG. 1, prior art mechanical internal rotating signal receivers provided low impedance coaxial transmission line through the back of the circular waveguide at 6 to LP portion 7. However, RP portion 5 of transmission line 4 presents an incorrect impedance to the incident signal, because the energy is coupled from the high impadence end of RP portion 5 by transmission line portion 9 and the low impedance end of RP portion 5 is open circuited. Thus, the transmission line and RP portion impedances present in this configuration are reversed for effective detection of an incident wave.

Figure 2:
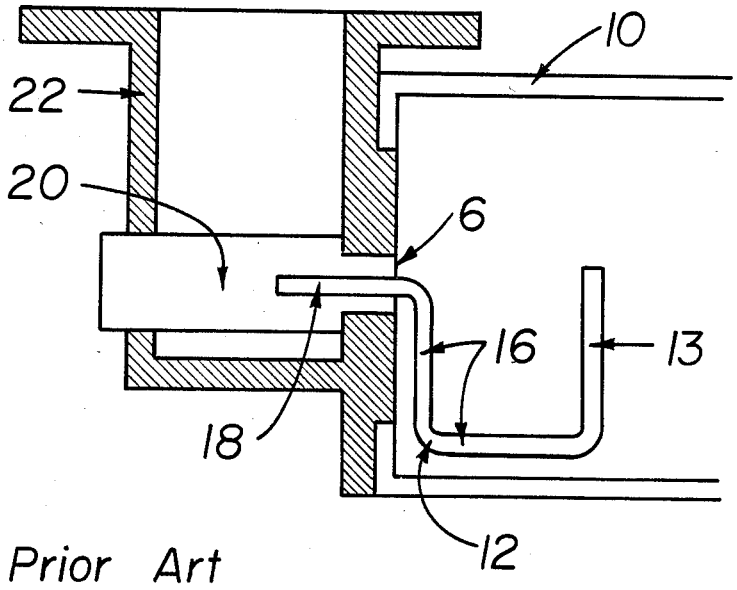
FIG. 2 is a cross-sectional view of a waveguide assembly with internal rotating signal detector constructed according to the principles of the present invention.

Referring now to FIG. 2, one embodiment of the present invention comprises circular waveguide 10 perpendicularly coupled to rectangular waveguide 22 and including signal conductor 12 fixedly mounted in insulator 20. Signal conductor 12 includes RP portion 13 oriented orthogonal to the axis of symmetry of circular waveguide 10, LP portion 18 extending into, and orthogonal to the axis of, waveguide 22, and coupled to RP portion 13 by transmission line portions 16. Signal conductor 12 is typically constructed of a single, continuous homogenous electrical conductor wherein RP portion 13 is approximately one-quarter wavelength long and transmission line portions 16 form a transmission line in the same manner that any single wire above a ground plane becomes a transmission line. The portion of signal conductor 12, extending through the rear wall of round waveguide 10 at 6, forms a low impedance coaxial transmission line. LP portion 18 launches the detected signal into rectangular waveguide 22.

Insulator 20, constructed of polystyrene or other suitable dielectric rod, provides mounting for signal conductor 12, electrical insulation of the line from the walls of waveguides 10 and 22, and for selective rotation of signal conductor 12 about its axis of symmetry. Since signal conductor 12 is concentric with axis of rotation of insulator 20, rotation of insulator 20 about its axis rotates LP portion 18, which correspondingly rotates RP portion 13 orthogonally about the axis of symmetry of waveguide 10. RP portion 13 is thereby oriented to the polarity of the desired incident signal for detection.

Figure 3:
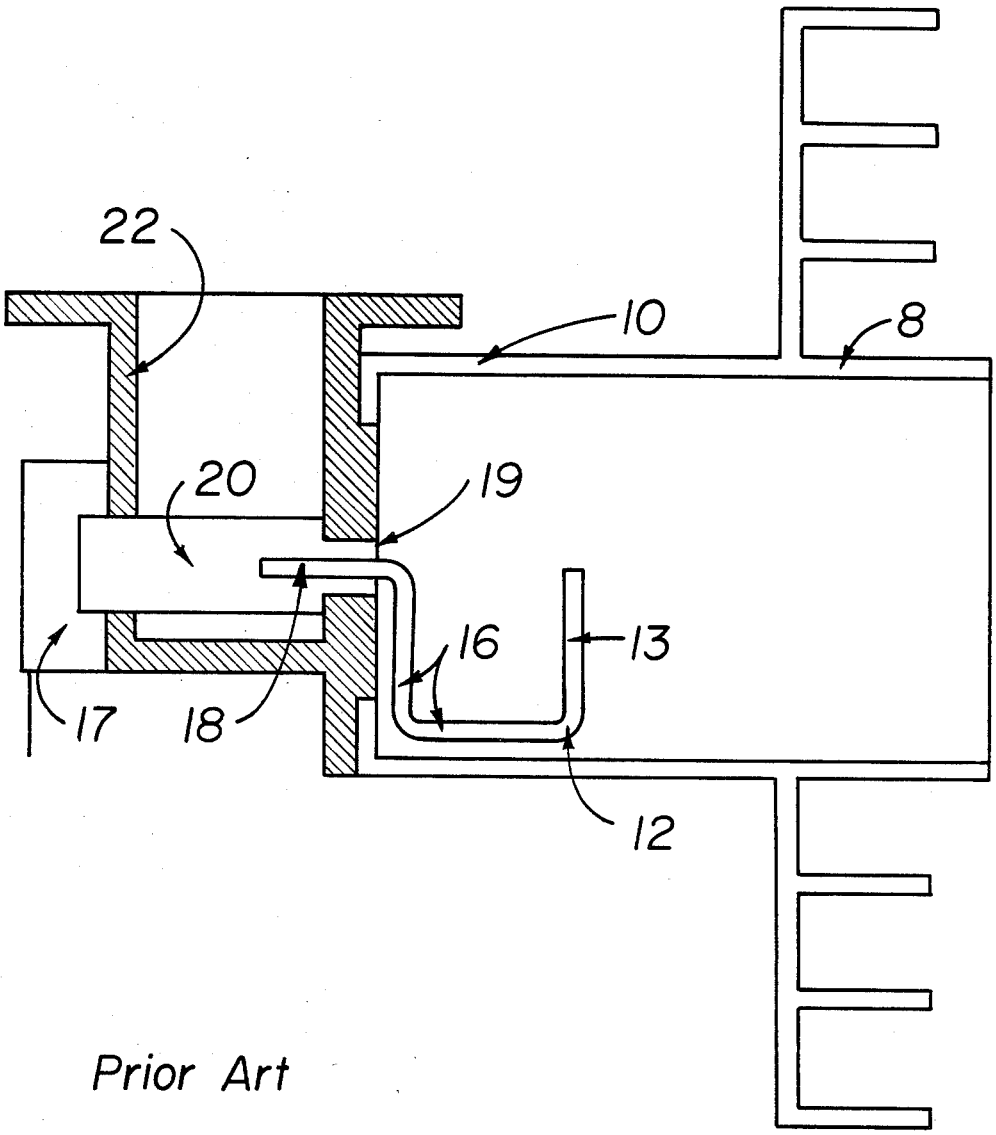
Prior Art Fig. 3
FIG. 3 is a cross-sectional view of the waveguide assembly and internal rotating signal detector of FIG. 2 further including a feed horn.

A preferred embodiment of the present invention is shown in FIG. 3. In this configuration, circular waveguide 10 is coaxially coupled to feed horn 8 at one end and perpendicularly coupled to rectangular waveguide 22 at the other end. As in the configuration of FIG. 2, signal conductor 12 is coupled to insulator 20, which is coupled to servo motor 17 for positioning. Servo motor 17 is usually the same as or similar to servo motors used in remotely controlled model aircraft for control surface movement. Obviously, with the addition of servo motor 17, operation of the detector system may be remotely controlled from the operator's panel. Feed horn 8 is of the type described in U.S. patent application Ser. No. 271,815, filed on June 8, 1981, now U.S. Pat. No. Des. 272,910. It could also be of any other suitable type such as described in U.S. patent application Ser. No. 271,130, filed June 8, 1981, now abandoned, or U.S. patent application Ser. No. 292,509, filed on Aug. 13, 1981, now U.S. Pat. No. 4,380,014.

The direction of signals transmitted in waveguide 22 is orthogonal to the direction of signals transmitted in waveguide 10. This configuration facilitates the simplicity of the present invention, since launching of signals into waveguide 22 is insensitive to rotation of LP portion 18, which rotation directly results from rotation of RP portion 13 necessary to select the desired signal. Similarly, the signal transmission characteristics of transmission line portions 16 are also substantially unaffected by rotation of RP portion 13, since they remain in the same relationship with the rear and circular walls of circular waveguide 10.

LP portion 18 is capable of launching the detected signal into another waveguide of any shape or into coaxial cable transmission line. Thus, as the signal conductor 12 rotates, RP portion 13 rotates orthogonally to, and LP portion 18 rotates concentrically with the axis of symmetry of the circular waveguide. As RP portion 13 aligns with the desired linearly polarized signal present in the circular waveguide, the signal is detected and conducted along the transmission line portion to the LP portion, which launches the detected signal. As stated earlier in this specification, the launched signal or the signal received at the LNA (not shown) is unaffected by the orientation of RP portion 13 because LP portion 18 rotates about its axis of symmetry, such rotation retains the relative position of LP portion 18 with waveguide 22, and the transmission characteristics of transmission line portions 16 are substantially unaffected.

Figure 4A:
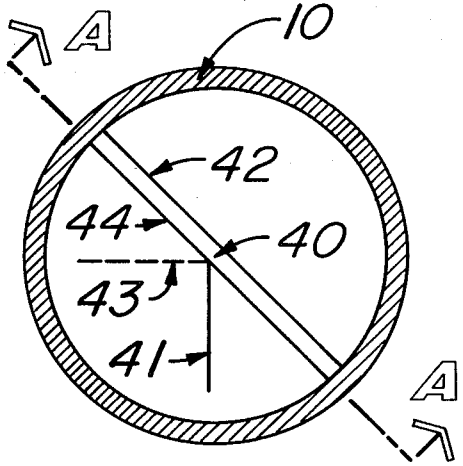
FIG. 4A is a sectional view at A—A of the waveguide assembly and internal rotating signal detector of FIG. 4.
Figure 4:
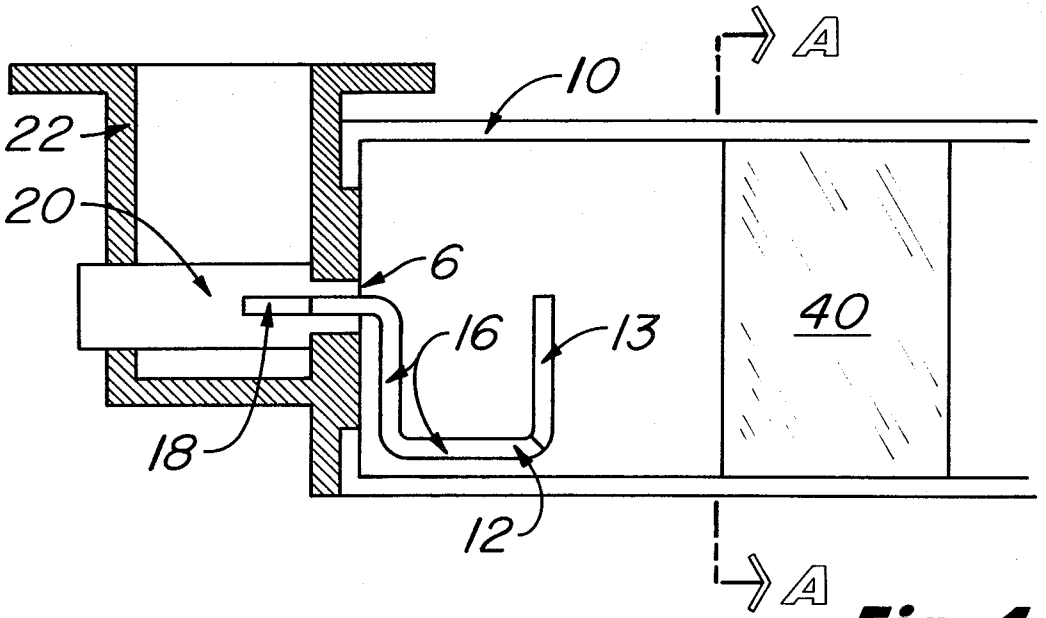
FIG. 4 is a cross-sectional view of the waveguide assembly and internal rotating signal detector of FIG. 2 including a signal polarizing insert.

In another preferred embodiment, circularly polarized signals may be received or transmitted. Referring to FIGS. 4 and 4A, dielectric insert 40 is diametrically and fixedly mounted in circular waveguide 10 intermediate RP portion 13 of signal conductor 12 and the incident signal. Dielectric insert 40 is slab-like, or planar, having two surfaces 42 and a thickness much less than its width or length, which, of course, can be equal. When mounted, the thickness dimension is co-linear with the diameter of waveguide 10. Insert 40 can be constructed of the same or similar materials as insulator 20. Insert 40 transforms RCP or LCP into linearly polarized signals rotated 90 degrees from each other. Thus referring to FIG. 4A, signal polarization 41 is RCP and signal polarization 43 is LCP. While, for convenience of illustration, dielectric insert 40 is shown at approximately 45 degrees with respect to vertical in FIG. 4A, it can be mounted at any convenient angle with respect to vertical. The important relationship is the orientation of RP portion 13 with respect to the desired signal to be received. RCP and LCP are linearly polarized at 45 degrees with respect to a surface 42 of insert 40. Thus, since RP portion 13 is aligned in parallel with the signal 41 in FIGS. 4 and 4A, RCP will be received in the orientation shown. By rotating RP portion 13 90 degrees, LCP will be received.

Similarly, when the RP portion is parallel or orthogonal to the insert 40, then linear polarization can be received without loss if the entire horn is rotated so that insert 40 is parallel or perpendicular, respectively, to the incoming polarization.

In the case of satellite-to-earth paths and an antenna on a polar mount, insert 40 would be placed parallel (or perpendicular) to the polar axis and the antenna would be capable of receiving RCP, LCP or either linear polarization.

Figure 5:
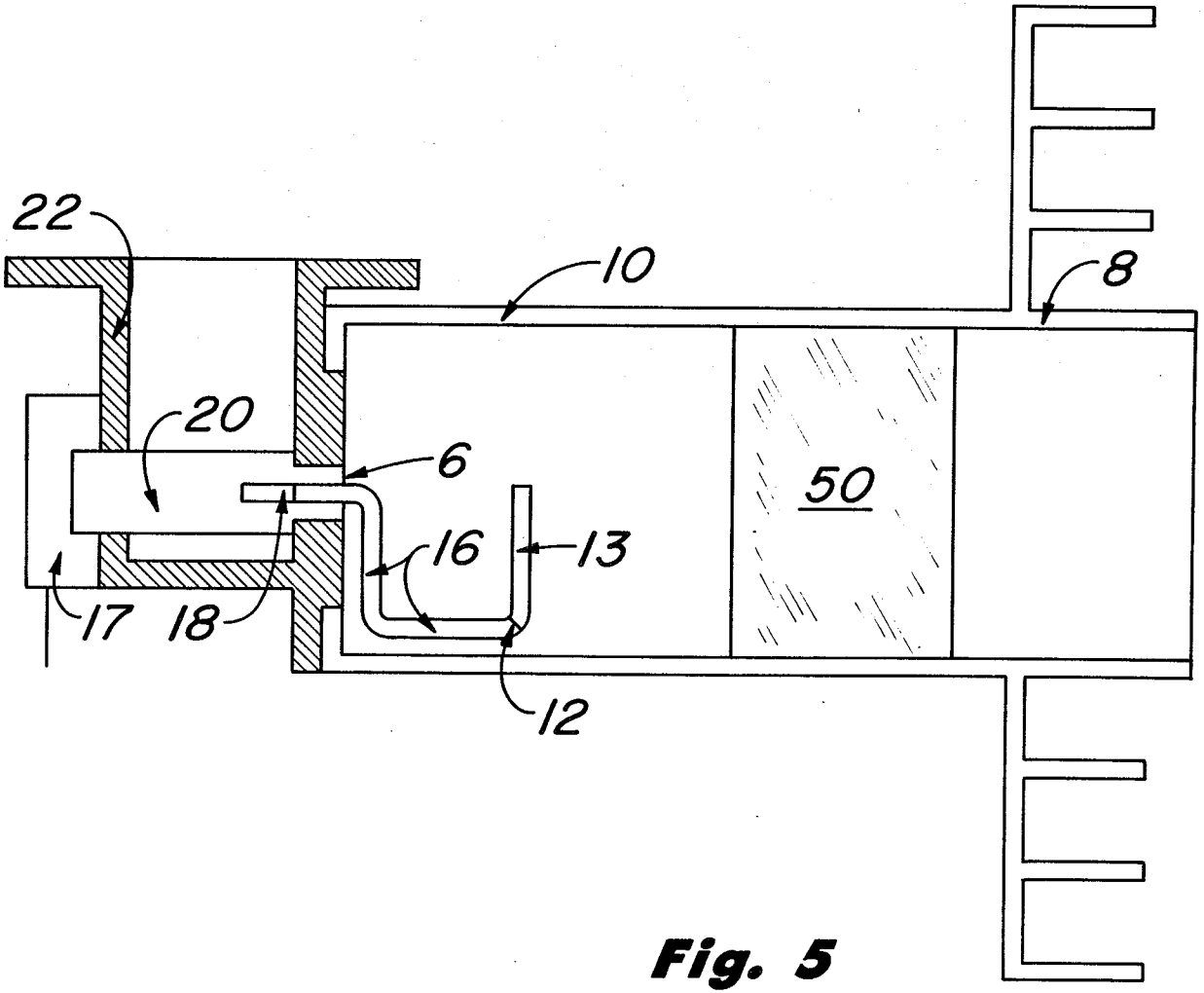
FIG. 5 is a cross-sectional view of the waveguide assembly and internal rotating signal detector of FIG. 3 further including a signal polarizing insert.

Referring now to FIG. 5, insert 50 is mounted intermediate RP portion 13 and the signal from feed horn 8 in the same manner as insert 40 in the configuration of FIG. 4. Similarly, insert 50 transforms RCP or LCP into linearly polarized signals rotated 90 degrees from each other. Either RCP or LCP is detected, depending on the orientation of RP portion 13 with respect to the incoming signals.

I claim:

1. A polarized signal receiver comprising:

a first waveguide for transmitting polarized signals;

a circular waveguide for receiving polarized signals at one end and coupled to the first waveguide at the other end, said other end having a rear wall;

an insulator rod, rotatably mounted through said other end of the circular waveguide;

signal conducting means, fixedly mounted in the insulator rod concentric with the axis of rotation thereof having a receiver probe portion oriented in the circular waveguide orthogonal to the axis of said circular waveguide for receiving one polarization of the incident signal, a launch probe portion concentric with the insulator rod and extending into the first waveguide for launching said signal therein, and a transmission line portion, having a first section contoured to the inside surface of the circular wall, and substantially parallel to the axis, of the circular waveguide, and having a second section contoured to the inside surface, and substantially parallel to the plane, of the rear wall of the circular waveguide, for connecting the receiver probe portion to the launch probe portion; and transformation means intermediate the incoming signals and the signal conducting means for transforming circularly polarized signals to linearly polarized signals.

2. A polarized signal reciver as in claim 1 wherein said transformation means comprise dielectric material having thickness, width and length dimensions, said thickness dimension being much less than the width or length dimensions and being oriented in parallel with the axis of symmetry of the circular waveguide.

3. A polarized signal receiver as in claim 1 wherein the receiver probe portion receives the linearly polarized signal from the transformation means with which it is co-linearly aligned.

4. A polarized signal receiver in claim 3 wherein the tranformation means simultaneously transforms both left and right circularly polarized signals into linearly polarized signals which are rotated ninety degrees from each other.

5. A polarized signal receiver as in claim 4 wherein the receiver probe portion may be rotated for receiving the linearly polarized from the transformation means.

* * * * *